US007242147B2

(12) United States Patent
Jin

(10) Patent No.: US 7,242,147 B2
(45) Date of Patent: Jul. 10, 2007

(54) CURRENT SHARING SCHEME FOR MULTIPLE CCF LAMP OPERATION

(75) Inventor: Xiaoping Jin, Orange, CA (US)

(73) Assignee: Microsemi Corporation, Irvine, CA (US)

( * ) Notice: Subject to any disclaimer, the term of this patent is extended or adjusted under 35 U.S.C. 154(b) by 125 days.

(21) Appl. No.: 10/958,668

(22) Filed: Oct. 5, 2004

(65) Prior Publication Data

US 2005/0093471 A1 May 5, 2005

Related U.S. Application Data

(60) Provisional application No. 60/508,932, filed on Oct. 6, 2003.

(51) Int. Cl.
*H05B 37/00* (2006.01)
*H02M 5/45* (2006.01)

(52) U.S. Cl. ..... 315/177; 315/246; 315/224; 315/276; 363/37; 363/34

(58) Field of Classification Search ..... 315/177, 315/246, 276, 312, 224, 291, 294, DIG. 5, 315/277, 211, 209 R; 363/37, 34
See application file for complete search history.

(56) References Cited

U.S. PATENT DOCUMENTS 2,429,162 A 10/1947 Russell et al.
2,440,984 A 5/1948 Summers
2,572,258 A 10/1951 Goldfield et al.
2,965,799 A 12/1960 Brooks et al.
2,968,028 A 1/1961 Eilichi et al.
3,141,112 A 7/1964 Eppert
3,565,806 A 2/1971 Ross
3,597,656 A * 8/1971 Douglas ..... 361/44
3,611,021 A 10/1971 Wallace
3,683,923 A 8/1972 Anderson
3,737,755 A 6/1973 Calkin et al.
3,742,330 A 6/1973 Hodges et al.
3,936,696 A 2/1976 Gray (Continued)

FOREIGN PATENT DOCUMENTS

EP 0647021 A1 9/1994

(Continued)

OTHER PUBLICATIONS

Copending U.S. Appl. No. 10/959,667, filed on Oct. 5, 2004, in the name of Xiaoping Jin. U.S. Appl. No. 10/959,667 has been not yet been assigned to an Examiner.

(Continued)

*Primary Examiner*—Tho Phan
*Assistant Examiner*—Chuc Tran
(74) *Attorney, Agent, or Firm*—Knobbe, Martens, Olson & Bear LLP

(57) ABSTRACT

A ring balancer comprising a plurality of balancing transformers facilitates current sharing in a multi-lamp backlight system. The balancing transformers have respective primary windings separately coupled in series with designated lamps and have respective secondary windings coupled together in a closed loop. The secondary windings conduct a common current and the respective primary windings conduct proportional currents to balance currents among the lamps. The ring balancer facilitates automatic lamp striking and the lamps can be advantageously driven by a common voltage source.

12 Claims, 11 Drawing Sheets

U.S. PATENT DOCUMENTS

| | | | | |
|---|---|---|---|---|
| 3,944,888 | A * | 3/1976 | Clark | 361/46 |
| 4,060,751 | A | 11/1977 | Anderson | |
| 4,353,009 | A | 10/1982 | Knoll | |
| 4,388,562 | A | 6/1983 | Josephson | |
| 4,441,054 | A | 4/1984 | Bay | |
| 4,463,287 | A | 7/1984 | Pitel | |
| 4,523,130 | A | 6/1985 | Pitel | |
| 4,567,319 | A | 1/1986 | Finley | |
| 4,572,992 | A | 2/1986 | Masaki | |
| 4,574,222 | A | 3/1986 | Anderson et al. | |
| 4,622,496 | A | 11/1986 | Dattilo et al. | |
| 4,630,005 | A | 12/1986 | Clegg et al. | |
| 4,663,566 | A | 5/1987 | Nagano | |
| 4,663,570 | A | 5/1987 | Luchaco et al. | |
| 4,672,300 | A | 6/1987 | Harper | |
| 4,675,574 | A * | 6/1987 | Delflache | 315/130 |
| 4,686,059 | A | 8/1987 | Payerle | |
| 4,686,615 | A | 8/1987 | Ferguson | |
| 4,698,554 | A | 10/1987 | Stupp | |
| 4,700,113 | A | 10/1987 | Stupp et al. | |
| 4,761,722 | A | 8/1988 | Pruitt | |
| 4,766,353 | A | 8/1988 | Burgess | |
| 4,780,696 | A | 10/1988 | Jirka | |
| 4,847,745 | A | 7/1989 | Shekhawat | |
| 4,862,059 | A | 8/1989 | Tominaga et al. | |
| 4,893,069 | A | 1/1990 | Harada et al. | |
| 4,939,381 | A | 7/1990 | Shibata | |
| 5,023,519 | A | 6/1991 | Jensen | |
| 5,030,887 | A | 7/1991 | Guisinger | |
| 5,036,255 | A | 7/1991 | McKnight et al. | |
| 5,057,808 | A | 10/1991 | Dhyanchand | |
| 5,173,643 | A | 12/1992 | Sullivan et al. | |
| 5,349,272 | A | 9/1994 | Rector | |
| 5,434,477 | A | 7/1995 | Crouse et al. | |
| 5,475,284 | A | 12/1995 | Lester et al. | |
| 5,485,057 | A | 1/1996 | Smallwood et al. | |
| 5,519,289 | A | 5/1996 | Katyl et al. | |
| 5,539,281 | A | 7/1996 | Shackle et al. | |
| 5,557,249 | A | 9/1996 | Reynal | |
| 5,563,473 | A | 10/1996 | Mattas et al. | |
| 5,574,335 | A | 11/1996 | Sun | |
| 5,574,356 | A | 11/1996 | Parker | |
| 5,615,093 | A | 3/1997 | Nalbant | |
| 5,619,402 | A | 4/1997 | Liu | |
| 5,621,281 | A | 4/1997 | Kawabata et al. | |
| 5,652,479 | A | 7/1997 | LoCascio et al. | |
| 5,712,776 | A | 1/1998 | Palara et al. | |
| 5,754,012 | A | 5/1998 | LoCascio | |
| 5,818,172 | A | 10/1998 | Lee | |
| 5,822,201 | A | 10/1998 | Kijima | |
| 5,825,133 | A | 10/1998 | Conway | |
| 5,828,156 | A * | 10/1998 | Roberts | 310/317 |
| 5,892,336 | A | 4/1999 | Lin et al. | |
| 5,910,713 | A | 6/1999 | Nishi et al. | |
| 5,912,812 | A | 6/1999 | Moriarty, Jr. | |
| 5,914,842 | A | 6/1999 | Sievers | |
| 5,923,129 | A | 7/1999 | Henry | |
| 5,930,121 | A | 7/1999 | Henry | |
| 5,930,126 | A * | 7/1999 | Griffin et al. | 363/37 |
| 5,936,360 | A | 8/1999 | Kaneko | |
| 6,002,210 | A | 12/1999 | Nilssen | |
| 6,020,688 | A | 2/2000 | Moisin | |
| 6,028,400 | A | 2/2000 | Pol et al. | |
| 6,037,720 | A | 3/2000 | Wong et al. | |
| 6,038,149 | A | 3/2000 | Hiraoka et al. | |
| 6,040,662 | A | 3/2000 | Asayama | |
| 6,043,609 | A | 3/2000 | George et al. | |
| 6,049,177 | A | 4/2000 | Felper | |
| 6,072,282 | A | 6/2000 | Adamson | |
| 6,104,146 | A | 8/2000 | Chou et al. | |
| 6,108,215 | A | 8/2000 | Kates et al. | |
| 6,114,814 | A | 9/2000 | Shannon et al. | |
| 6,121,733 | A | 9/2000 | Nilssen | |
| 6,127,785 | A | 10/2000 | Williams | |
| 6,127,786 | A | 10/2000 | Moisin | |
| 6,137,240 | A | 10/2000 | Bogdan | |
| 6,150,772 | A | 11/2000 | Crane | |
| 6,169,375 | B1 | 1/2001 | Moisin | |
| 6,181,066 | B1 | 1/2001 | Adamson | |
| 6,181,083 | B1 | 1/2001 | Moisin | |
| 6,181,084 | B1 | 1/2001 | Lau | |
| 6,188,553 | B1 | 2/2001 | Moisin | |
| 6,198,234 | B1 | 3/2001 | Henry | |
| 6,198,236 | B1 | 3/2001 | O'Neill | |
| 6,215,256 | B1 | 4/2001 | Ju | |
| 6,218,788 | B1 | 4/2001 | Chen et al. | |
| 6,259,615 | B1 | 7/2001 | Lin | |
| 6,281,636 | B1 | 8/2001 | Okutsu et al. | |
| 6,281,638 | B1 | 8/2001 | Moisin | |
| 6,307,765 | B1 | 10/2001 | Choi | |
| 6,310,444 | B1 | 10/2001 | Chang | |
| 6,316,881 | B1 | 11/2001 | Shannon et al. | |
| 6,320,329 | B1 | 11/2001 | Wacyk | |
| 6,323,602 | B1 | 11/2001 | De Groot et al. | |
| 6,344,699 | B1 | 2/2002 | Rimmer | |
| 6,362,577 | B1 | 3/2002 | Ito et al. | |
| 6,396,722 | B2 | 5/2002 | Lin | |
| 6,417,631 | B1 | 7/2002 | Chen et al. | |
| 6,420,839 | B1 | 7/2002 | Chiang et al. | |
| 6,433,492 | B1 | 8/2002 | Buonauita | |
| 6,441,943 | B1 | 8/2002 | Roberts et al. | |
| 6,445,141 | B1 | 9/2002 | Kastner et al. | |
| 6,459,215 | B1 | 10/2002 | Nerone et al. | |
| 6,459,216 | B1 | 10/2002 | Tsai | |
| 6,469,922 | B2 | 10/2002 | Choi | |
| 6,472,827 | B1 | 10/2002 | Nilssen | |
| 6,472,876 | B1 | 10/2002 | Notohamiprodjo et al. | |
| 6,486,618 | B1 | 11/2002 | Li | |
| 6,494,587 | B1 | 12/2002 | Shaw et al. | |
| 6,501,234 | B2 | 12/2002 | Lin et al. | |
| 6,509,696 | B2 | 1/2003 | Bruning et al. | |
| 6,515,427 | B2 | 2/2003 | Oura et al. | |
| 6,515,881 | B2 | 2/2003 | Chou et al. | |
| 6,522,558 | B2 | 2/2003 | Henry | |
| 6,531,831 | B2 | 3/2003 | Chou et al. | |
| 6,534,934 | B1 | 3/2003 | Lin et al. | |
| 6,559,606 | B1 | 5/2003 | Chou et al. | |
| 6,570,344 | B2 | 5/2003 | Lin | |
| 6,628,093 | B2 | 9/2003 | Stevens | |
| 6,633,138 | B2 | 10/2003 | Shannon et al. | |
| 6,680,834 | B2 | 1/2004 | Williams | |
| 6,864,867 | B2 | 3/2004 | Biebl | |
| 6,717,372 | B2 | 4/2004 | Lin et al. | |
| 6,765,354 | B2 | 7/2004 | Klien et al. | |
| 6,781,325 | B2 | 8/2004 | Lee | |
| 6,784,627 | B2 | 8/2004 | Suzuki et al. | |
| 6,804,129 | B2 | 10/2004 | Lin | |
| 6,922,023 | B2 * | 7/2005 | Hsu et al. | 315/291 |
| 6,930,893 | B2 | 8/2005 | Vinciarelli | |
| 6,936,975 | B2 * | 8/2005 | Lin et al. | 315/224 |
| 2001/0036096 | A1 | 11/2001 | Lin | |
| 2002/0030451 | A1 | 3/2002 | Moisin | |
| 2002/0097004 | A1 | 7/2002 | Chiang et al. | |
| 2002/0135319 | A1 | 9/2002 | Bruning et al. | |
| 2002/0140538 | A1 | 10/2002 | Yer | |
| 2002/0145886 | A1 | 10/2002 | Stevens | |
| 2002/0171376 | A1 | 11/2002 | Rust et al. | |
| 2002/0180380 | A1 | 12/2002 | Lin | |
| 2002/0180572 | A1 | 12/2002 | Kakehashi et al. | |
| 2002/0181260 | A1 | 12/2002 | Chou et al. | |
| 2002/0195971 | A1 | 12/2002 | Qian et al. | |
| 2003/0001524 | A1 | 1/2003 | Lin et al. | |
| 2003/0090913 | A1 | 5/2003 | Che-Chen et al. | |
| 2003/0117084 | A1 | 6/2003 | Stack | |

| | | | | |
|---|---|---|---|---|
| 2003/0141829 | A1 | 7/2003 | Yu | |
| 2004/0032223 | A1 | 2/2004 | Henry | |
| 2004/0155596 | A1 | 8/2004 | Ushijima | |
| 2004/0257003 | A1* | 12/2004 | Hsieh et al. | 315/246 |
| 2004/0263092 | A1 | 12/2004 | Liu | |
| 2005/0093471 | A1 | 5/2005 | Jin | |
| 2005/0093472 | A1 | 5/2005 | Jin | |
| 2005/0093482 | A1 | 5/2005 | Ball | |
| 2005/0093483 | A1 | 5/2005 | Ball | |
| 2005/0093484 | A1 | 5/2005 | Ball | |
| 2005/0094372 | A1 | 5/2005 | Jin | |
| 2005/0099143 | A1 | 5/2005 | Kohno | |
| 2005/0156539 | A1 | 7/2005 | Ball | |
| 2005/0162098 | A1 | 7/2005 | Ball | |
| 2005/0225261 | A1 | 10/2005 | Jin | |

FOREIGN PATENT DOCUMENTS

| | | |
|---|---|---|
| JP | 8-204488 | 8/1996 |
| TW | 200524481 | 12/2003 |
| TW | 200501829 | 1/2005 |
| WO | WO 94/15444 | 7/1994 |

OTHER PUBLICATIONS

Williams, B. W., "Power Electronics Devices, Drivers, Applications and Passive Components". Second Edition, McGraw-Hill, 1992., Chapter 10, pp. 218-249. no date available.

Bradley, D.A., "Power Electronics" 2nd Edition; Chapman & Hall, 1995; Chapter 1, pp. 1-38. no date available.

Dubey, G.K., Thyristorised Power Controllers; Halsted Press, 1986; pp. 74-77. no date available.

* cited by examiner

CURRENT SHARING SCHEME FOR MULTIPLE CCF LAMP OPERATION

CLAIM FOR PRIORITY

This application claims the benefit of priority under 35 U.S.C. § 119(e) of U.S. Provisional Application No. 60/508,932, filed on Oct. 6, 2003, and entitled A CURRENT SHARING SCHEME AND SHARING DEVICES FOR MULTIPLE CCF LAMP OPERATION, the entirety of which is incorporated herein by reference.

BACKGROUND OF THE INVENTION

1. Field of the Invention

The present invention relates generally to balancing transformers and more particularly to a ring balancer used for current sharing in a multi-lamp backlight system.

2. Description of the Related Art

In liquid crystal display (LCD) applications backlight is needed to illuminate the screen to make a visible display. With the increasing size of LCD display panels (e.g., LCD television or large screen LCD monitor), cold cathode fluorescent lamp (CCFL) backlight systems may operate with multiple lamps to obtain high quality illumination for the display. One of the challenges to a multiple lamp operation is how to maintain substantially equal or controlled operating currents for the respective lamps, thereby yielding the desired illumination effect on the display screen, while reducing electronic control and power switching devices to reduce system cost. Some of the difficulties are discussed below.

The variation in operating voltage of a CCFL is typically around ±20% for a given current level. When multiple lamps are connected in parallel across a common voltage source, equal current sharing among the lamps is difficult to achieve without a current balancing mechanism. Moreover, lamps with higher operating voltages may not ignite after ignition of lower operating voltage lamps.

In constructing a display panel with multiple lamps, it is difficult to provide identical surrounding conditions for each lamp. Thus, parasitic parameters for each lamp vary. The parasitic parameters (e.g., parasitic reactance or parasitic capacitance) of the lamps sometimes vary significantly in a typical lamp layout. Differences in parasitic capacitance result in different capacitive leakage current for each lamp at high frequency and high voltage operating conditions, which is a variable in the effective lamp current (and thus brightness) for each lamp.

One approach is to connect primary windings of transformers in series and to connect lamps across respective secondary windings of the transformers. Since the current flowing through the primary windings is substantially equal in such a configuration, the current through the secondary windings can be controlled by the ampere-turns balancing mechanism. In such a way, the secondary currents (or lamp currents) can be controlled by a common primary current regulator and the transformer turns ratios.

A limitation of the above approach occurs when the number of lamps, and consequently the number of transformers, increases. The input voltage is limited, thereby reducing the voltage available for each transformer primary winding as the number of lamps increases. The design of the associated transformers becomes difficult.

SUMMARY OF THE INVENTION

The present invention proposes a backlighting system for driving multiple fluorescent lamps, e.g., cold cathode fluorescent lamps (CCFLs) with accurate current matching. For example, when multiple loads in a parallel configuration are powered by a common alternating current (AC) source, the current flowing through each individual load can be controlled to be substantially equal or a predetermined ratio by inserting a plurality of balancing transformers in a ring balancer configuration between the common AC source and the multiple loads. The balancing transformers include respective primary windings individually connected in series with each load. Secondary windings of the balancing transformers are connected in series and in phase to form a short circuit loop. The secondary windings conduct a common current (e.g., a short circuit current). The currents conducted by the primary windings of the respective balancing transformers, and the currents flowing through the corresponding loads, are forced to be equal by using identical turns ratio for the transformers, or to be a pre-determined ratio by using different turns ratio.

The current matching (or current sharing) in the ring balancer is facilitated by the electromagnetic balancing mechanism of the balancing transformers and the electromagnetic cross coupling through the ring of secondary windings. The current sharing among multiple loads (e.g., lamps) is advantageously controlled with a simple passive structure without employing additional active control mechanism, reducing complexity and cost of the backlighting system. Unlike a conventional balun approach which becomes rather complicated and sometimes impractical when the number of loads increases, the above approach is simpler, less costly, easier to manufacture, and can balance the current of many more, theoretically unlimited number of, loads.

In one embodiment, a backlighting system uses a common AC source (e.g., a single AC source or a plurality of synchronized AC sources) to drive multiple parallel lamp structures with a ring balancer comprising a network of transformers with at least one transformer designated for each lamp structure. The primary winding of each transformer in the ring balancer is connected in series with its designated lamp structure, and multiple primary winding-lamp structure combinations are coupled in parallel across a single AC source or arranged in multiple parallel subgroups for connection to a set of synchronized AC sources. The secondary windings of the transformers are connected together in series to form a closed loop. The connection polarity in the transformer network is arranged in such a way that the voltages across each secondary winding are in phase in the closed loop when the voltage applied to the primary windings are in the same phase. Thus, a common short circuit current will flow through secondary windings in the series-connected loop when in-phase voltages are developed across the primary windings.

Lamp currents flow through the respective primary windings of the transformers and through the respective lamp structures to provide illumination. The lamp currents flowing through the respective primary windings are proportional to the common current flowing through the secondary windings if the magnetizing current is neglected. Thus, the lamp currents of different lamp structures can be substantially the same as or proportional to each other depending on the transformer turns ratios. In one embodiment, the transformers have substantially the same turns ratio to realize substantially matching lamp current levels for uniform brightness of the lamps.

In one embodiment, the primary windings of the transformers in the ring balancer are connected between high voltage terminals of the respective lamp structures and the common AC source. In another embodiment, the primary windings are connected between the return terminals of the respective lamp structures and the common AC source. In yet another embodiment, separate ring balancers are employed at both ends of the lamp structures. In a further embodiment, each of the lamp structures include two or more fluorescent lamps connected in series and the primary winding associated with each lamp structure is inserted between the fluorescent lamps.

In one embodiment, the common AC source is an inverter with a controller, a switching network and an output transformer stage. The output transformer stage can include a transformer with a secondary winding referenced to ground to drive the lamp structures in a single-ended configuration. Alternately, the output transformer stage can be configured to drive the lamp structures in floating or differential configurations.

In one embodiment, the backlight system further includes a fault detection circuit to detect open lamp or shorted lamp conditions by monitoring the voltage across the secondary windings in the ring balancer. For example, when a lamp structure has an open lamp, the voltages across the corresponding serially connected primary winding and associated secondary winding rises. When a lamp structure has a shorted lamp, the voltages across the primary windings and associated secondary windings of operating (or non-shorted) lamp structures rise. In one embodiment, the backlight system shuts down the common AC source when the fault detection circuit indicates an open lamp or shorted lamp condition.

In one embodiment, the ring balancer includes a plurality of balancing transformers. Each of the balancing transformers includes a magnetic core, a primary winding, and a secondary winding. In one embodiment, the magnetic core has high relative permeability with an initial relative permeability greater than 5,000.

The plurality of balancing transformers can have substantially identical turns ratios or different turns ratios for current control among the primary windings. In one embodiment, the magnetic core has a toroidal shape, and the primary winding and the secondary winding are wound progressively on separate sections of the magnetic core. In another embodiment, a single insulated wire goes through inner holes of toroidal shape magnetic cores in the ring balancer to form a closed loop of secondary windings. In yet another embodiment, the magnetic core is based on an E shaped structure with primary winding and secondary winding wound on separate sections of a bobbin.

These and other objects and advantages of the present invention will become more fully apparent from the following description taken in conjunction with the accompanying drawings. For purpose of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE INVENTION

Figure 1:
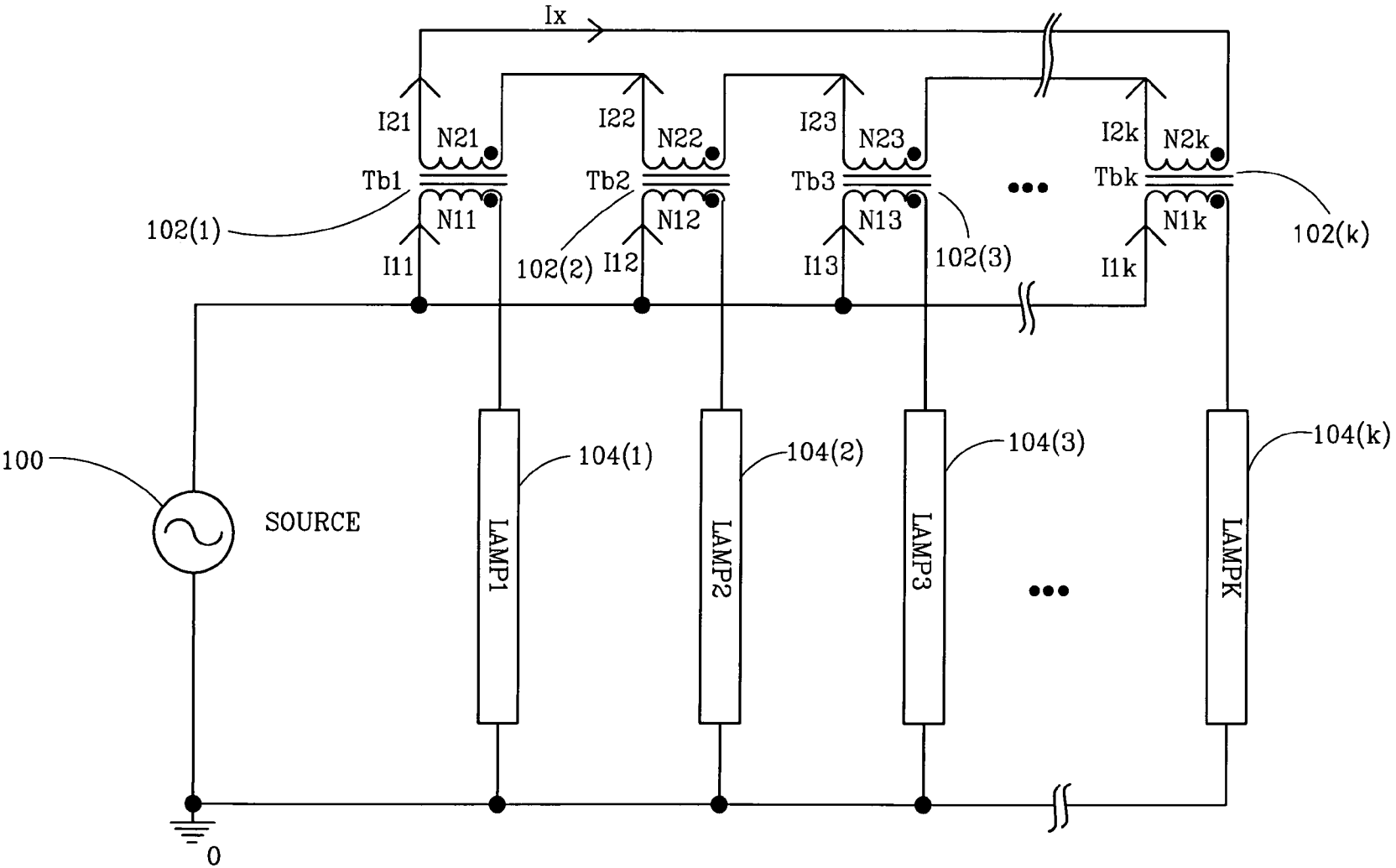
FIG. 1 is a schematic diagram of one embodiment of a backlight system with a ring balancer coupled between a source and high voltage terminals of multiple lamps.

Embodiments of the present invention will be described hereinafter with reference to the drawings. FIG. 1 is a schematic diagram of one embodiment of a backlight system with a ring balancer coupled between an input AC source 100 and high voltage terminals of multiple lamps (LAMP1, LAMP2, . . . LAMPK) shown as lamps 104(1)–104(*k*) (collectively the lamps 104). In one embodiment, the ring balancer comprises multiple balancing transformers (Tb1, Tb2, . . . Tbk) shown as balancing transformers 102(1)–102(*k*) (collectively the balancing transformers 102). Each of the balancing transformers 102 is designated for a different one of the lamps 104.

The balancing transformers 102 have respective primary windings coupled in series with their designated lamps 104. The balancing transformers 102 have respective secondary windings connected in series with each other and in phase to form a short circuit (or closed) loop. The polarity of the secondary windings is aligned so that the voltages induced in the secondary windings are in phase and add up together in the closed loop.

The primary winding-lamp combinations are coupled in parallel to the input AC source 100. The input AC source 100 is shown as a single voltage source in FIG. 1, and the primary windings are coupled between the high voltage terminals of the respective lamps 104 and the positive node of the input AC source 100. In other embodiments (not shown), the primary winding-lamp combinations are divided into subgroups with each subgroup comprising one or more parallel primary winding-lamp combinations. The subgroups can be driven by different voltage sources which are synchronized with each other.

With the above-described arrangement, a short circuit (or common) current (Ix) is developed in the secondary windings of the balancing transformers 102 when currents flow in the respective primary windings. Since the secondary windings are serially connected in a loop, the current circulating in each of the secondary winding is substantially equal. If the magnetizing currents of the balancing transformers 102 are neglected, the following relationship can be established for each of the balancing transformers 102:

$$N_{11}\cdot I_{11}=N_{21}\cdot I_{21};\ N_{12}\cdot I_{12}=N_{22}\cdot I_{22};\ \ldots\ N_{1k}\cdot I_{1k}=N_{2k}\cdot I_{2k}. \quad \text{(Eqn. 1)}$$

$N_{1k}$ and $I_{1k}$ denote the primary turns and primary current respectively of the Kth balancing transformer. $N_{2k}$ and $I_{2k}$ denote the secondary turns and secondary current respectively of the Kth balancing transformer. Thus it results:

$$I_{11}=(N_{21}/N_{11})\cdot I_{21};\ I_{12}=(N_{22}/N_{12})\cdot I_{22};\ \ldots\ I_{1k}=(N_{2k}/N_{1k})\cdot I_{2k}. \quad \text{(Eqn. 2)}$$

Since the secondary current is equalized with the serial connection of secondary windings:

$$I_{21}=I_{22}=\ldots=I_{2k}=Ix. \quad \text{(Eqn. 3)}$$

The primary currents and hence the lamp currents conducted by the respective lamps 104, can be controlled proportionally with the turns ratio ($N_{21}/N_{11}$, $N_{22}/N_{12}$, . . . $N_{2k}/N_{1k}$) of the balancing transformers 102 according to Eqn. 2. Physically, if any current in a particular balancing transformer deviates from the relationships defined in Eqn. 2, the resulting magnetic flux from the error ampere turns will induce a corresponding correction voltage in the primary winding to force the primary current to follow the balancing condition of Eqn. 2.

With the above described relationship, if equal lamp current is desired, it can be realized by setting substantially identical turns ratio for the balancing transformers 102 regardless of possible variations in the lamp operating voltage. Further, if the current of a particular lamp needs to be set at a different level from other lamps due to some practical reasons, such as differences in parasitic capacitance due to surrounding environment, it can be achieved by adjusting the turns ratio of the corresponding balancing transformer according to Eqn. 2. In this way the current of each lamp can be adjusted without using any active current sharing scheme or using a complicated balun structure. In addition to the above advantages, the proposed backlighting system can reduce the short circuit current when a lamp is shorted.

Furthermore, the proposed backlighting system facilitates automatic lamp striking. When a lamp is open or unlit, additional voltage across its designated primary winding, in phase with the input AC source 100, will be developed to help to strike the lamp. The additional voltage is generated by a flux increase due to the decrease in primary current. For example, when a particular lamp is not ignited, the lamp is effectively an open circuit condition. The current flowing in the corresponding primary winding of the balancing transformer is substantially zero. Because of the circulating current in the closed loop of secondary windings, the ampere turns balancing equation of Eqn. 1 cannot be maintained in such a situation. Excessive magnetizing force resulted from the unbalanced ampere turns will generate an additional voltage in the primary winding of the balancing transformer. The additional voltage adds in phase with the input AC source 100 to result in an automatic increase of the voltage across the non-ignited lamp, thus helping the lamp to strike.

It should be noted that the application of this invention is not limited to multiple lamps (e.g., CCFLs) in backlight systems. It also applies to other types of applications and different types of loads in which multiple loads are connected to a common AC source in parallel and current matching among the loads is desired.

It should also be noted that various circuit configurations can be realized with this invention in addition to the embodiment shown in FIG. 1. FIGS. 2–7 show examples of other embodiments of backlight systems using at least one ring balancer for current matching. In practical applications other types of configurations (not shown) can also be formulated based on the same concept, depending on the actual backlight system construction. For instance, it is possible to balance the current of multiple lamps when they are driven by more than one AC sources with this concept, as long as the multiple AC sources are synchronized and maintain the phase relations according to the principle of this concept.

Figure 2:
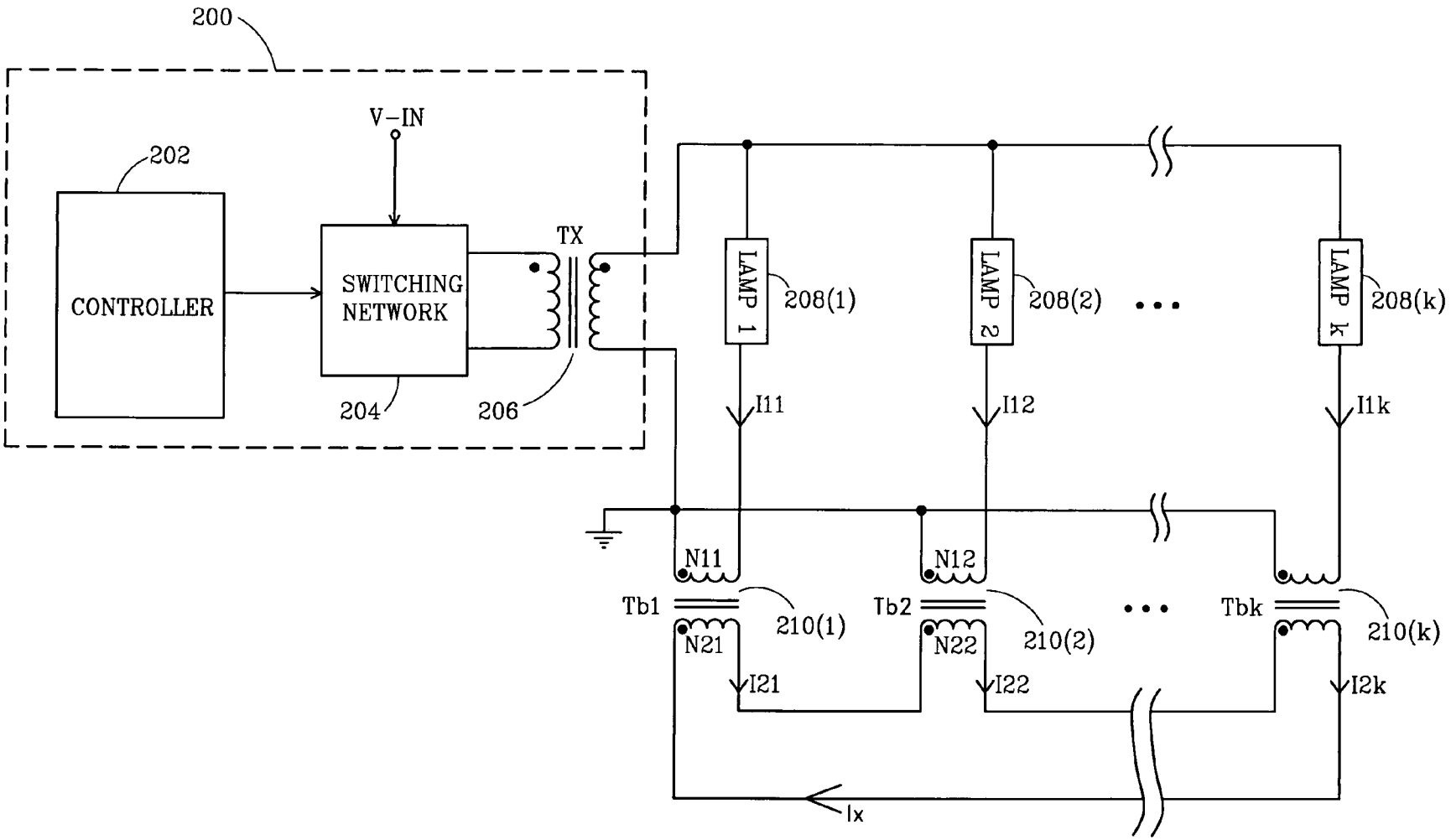
FIG. 2 is a schematic diagram of one embodiment of a backlight system with a ring balancer coupled between return terminals of multiple lamps and ground.

FIG. 2 is a schematic diagram of one embodiment of a backlight system with a ring balancer coupled between ground and return terminals of multiple lamps (LAMP 1, LAMP 2, . . . LAMP K) shown as lamps 208(1)–208(*k*) (collectively the lamps 208). In one embodiment, the ring balancer comprises multiple balancing transformers (Tb1, Tb2, . . . Tbk) shown as balancing transformers 210(1)–210(*k*) (collectively the balancing transformers 210). Each of the balancing transformers 210 is designated for a different one of the lamps 208.

The balancing transformers 210 have respective primary windings coupled in series with their designated lamps 208 and respective secondary windings connected in a serial ring. The embodiment shown in FIG. 2 is substantially similar to the embodiment shown in FIG. 1 except the ring balancer is coupled to return sides of the respective lamps 208. For example, the primary windings are coupled between the respective return terminals of the lamps 208 and ground. The high voltage terminals of the lamps 208 are coupled to a positive terminal of a voltage source 200.

By way of example, the voltage source 200 is shown in further detail as an inverter comprising a controller 202, a switching network 204 and an output transformer stage 206. The switching network 204 accepts a direct current (DC) input voltage (V-IN) and is controlled by driving signals from the controller 202 to generate an AC signal for the output transformer stage 206. In the embodiment shown in FIG. 2, the output transformer stage 206 includes a single transformer with a secondary winding referenced to ground to drive the lamps 208 and ring balancer in a single-ended configuration.

As described above in connection with FIG. 1, the ring balancer facilitates automatic increase of the voltage across a non-stricken lamp to guarantee reliable striking of lamps in backlight systems without additional components or mechanism. Lamp striking is one of the difficult problems in the operation of multiple lamps in a parallel configuration. With automatic lamp striking, the headroom typically reserved for striking operations in an inverter design can be reduced to achieve better efficiency of the inverter and lower crest factor of the lamp current through better optimization of transformer design in the output transformer stage 206, better utilization of switching duty cycle by the controller 202, lower transformer voltage stress, etc.

Figure 3:
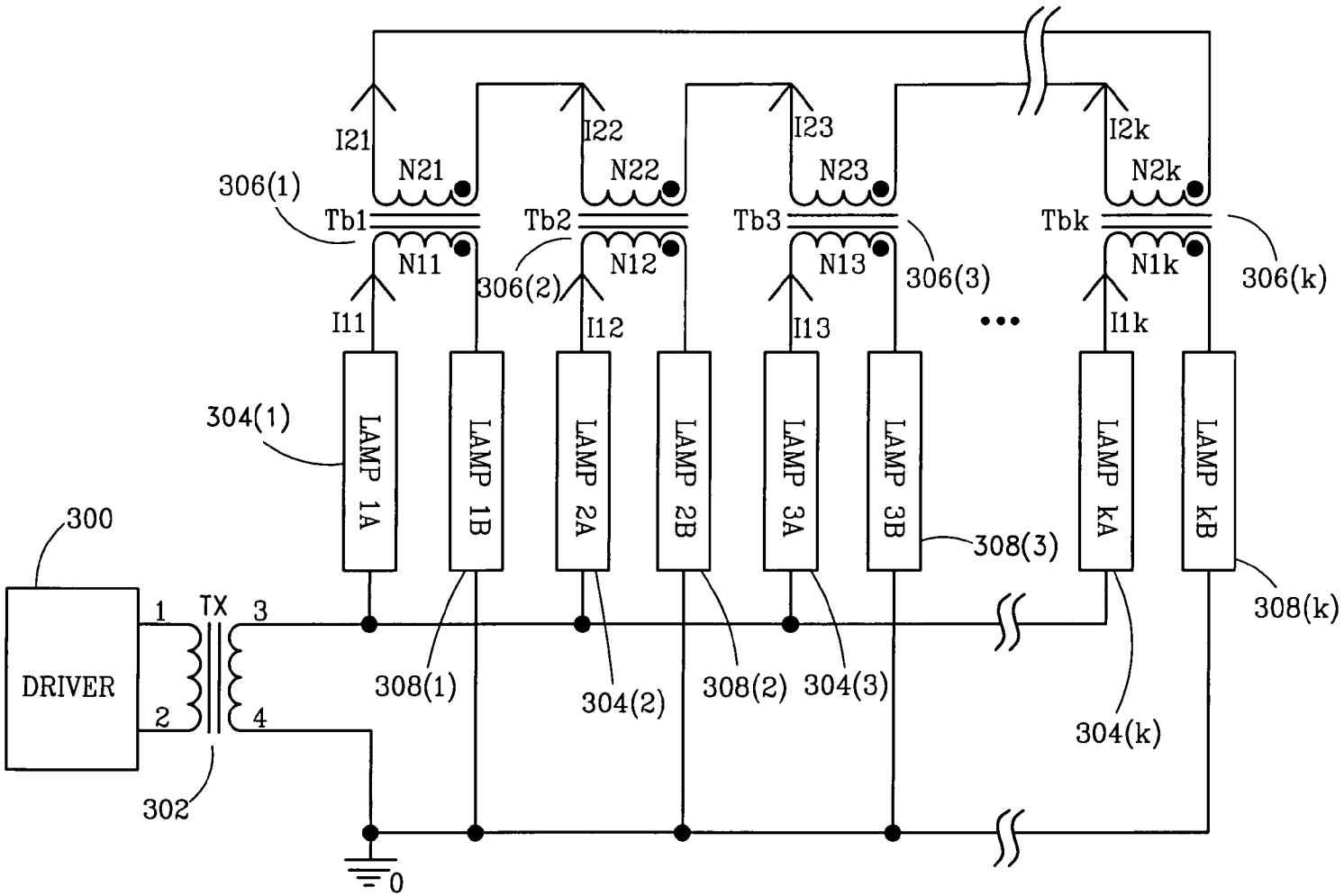
FIG. 3 is a schematic diagram of one embodiment of a backlight system with multiple pairs of lamps in a parallel configuration and a ring balancer inserted between the pairs of lamps.

FIG. 3 is a schematic diagram of one embodiment of a backlight system with multiple pairs of lamps in a parallel configuration and a ring balancer inserted between the pairs of lamps. For example, a first group of lamps (LAMP 1A, LAMP 2A, . . . LAMP kA) shown as lamps 304(1)–304(*k*)

(collectively the first group of lamps 304) are coupled between a high voltage terminal of an output transformer (TX) 302 and the ring balancer. A second group of lamps (LAMP 1B, LAMP 2B, . . . LAMP kB) shown as lamps 308(1)–308(*k*) (collectively the second group of lamps 308) are coupled between the ring balancer and a return terminal (or ground). A driver circuit 300 drives the output transformer 302 to provide an AC source for powering the first and second groups of lamps 304, 308.

In one embodiment, the ring balancer comprises a plurality of balancing transformers (Tb1, Tb2, . . . Tbk) shown as balancing transformers 306(1)–306(*k*) (collectively the balancing transformers 306). Each of the balancing transformers 306 is designated for a pair of lamps, one lamp from the first group of lamps 304 and one lamp from the second group of lamps 308. The balancing transformers 306 have respective secondary windings serially connected in a closed loop. In this configuration, the number of balancing transformers is advantageously half the number of lamps to be balanced.

For example, the balancing transformers 306 have respective primary windings inserted in series between their designated pairs of lamps. The first group of lamps 304 and the second group of lamps 308 are effectively coupled in series by pairs with a different primary winding inserted between each pair. The pairs of lamps with respective designated primary windings are coupled in parallel across the output transformer 302.

Figure 4:
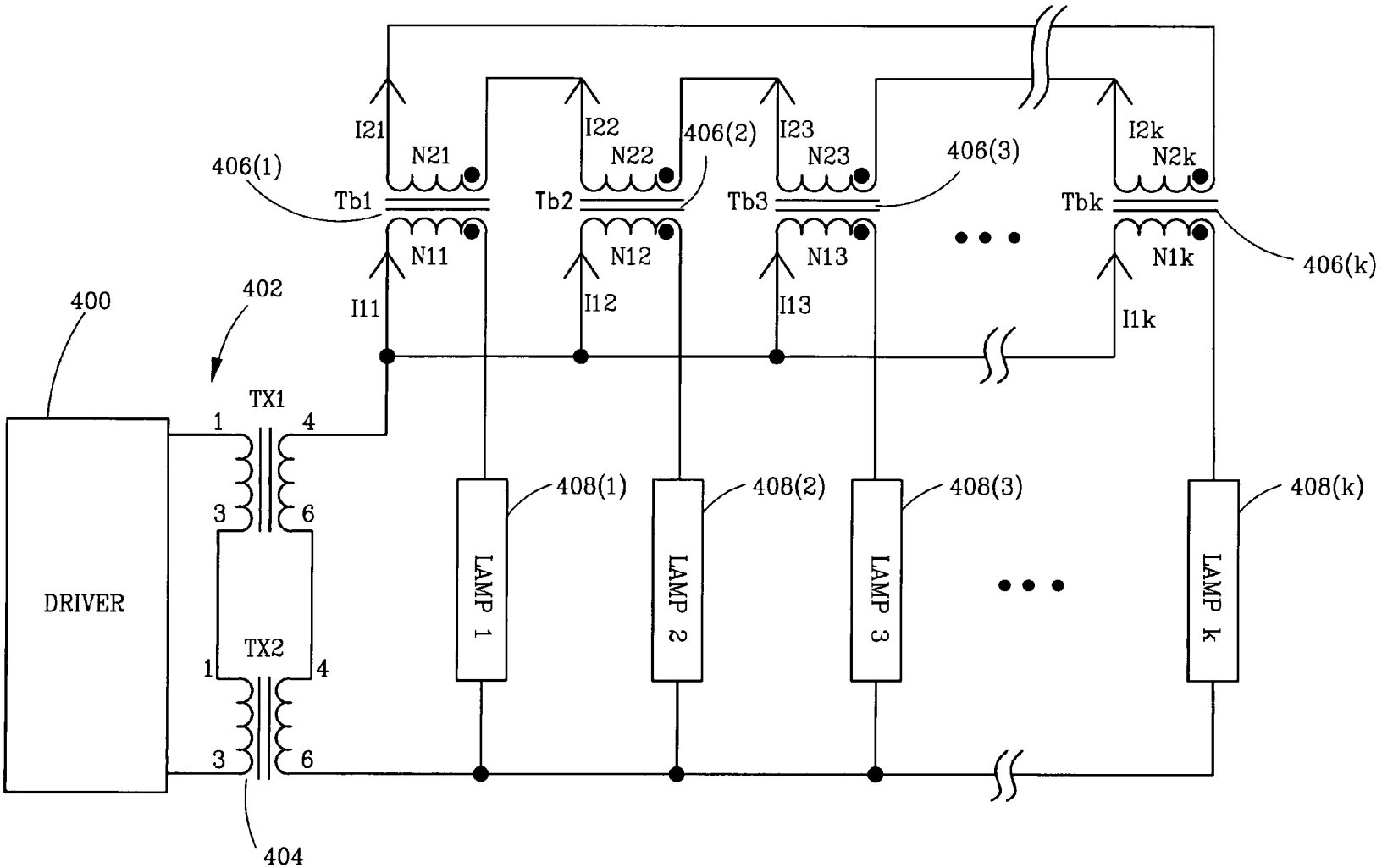
FIG. 4 is a schematic diagram of one embodiment of a backlight system with multiple lamps driven in a floating configuration.

FIG. 4 is a schematic diagram of one embodiment of a backlight system with multiple lamps driven in a floating configuration. For example, a driver circuit 400 drives an output transformer stage comprising of two transformers 402, 404 with respective primary windings connected in series and respective secondary windings connected in series. The serially connected secondary windings of the output transformers 402, 404 are coupled across a ring balancer and a group of lamps (LAMP 1, LAMP 2, . . . LAMP k) shown as lamps 408(1)–408(*k*) (collectively the lamp 408).

In one embodiment, the ring balancer comprise a plurality of balancing transformers (Tb1, Tb2, . . . Tbk) shown as balancing transformers 406(1)–406(*k*) (collectively the balancing transformers 406). Each of the balancing transformers 406 is dedicated to a different one of the lamps 408. The balancing transformers 406 have respective primary windings connected in series with their dedicated lamps 408 and respective secondary windings connected in series with each other in a closed loop. The primary winding-lamp combinations are coupled in parallel across the serially connected secondary windings of the output transformers 402, 404. The lamps 408 are driven in a floating configuration without reference to a ground terminal.

Figure 5:
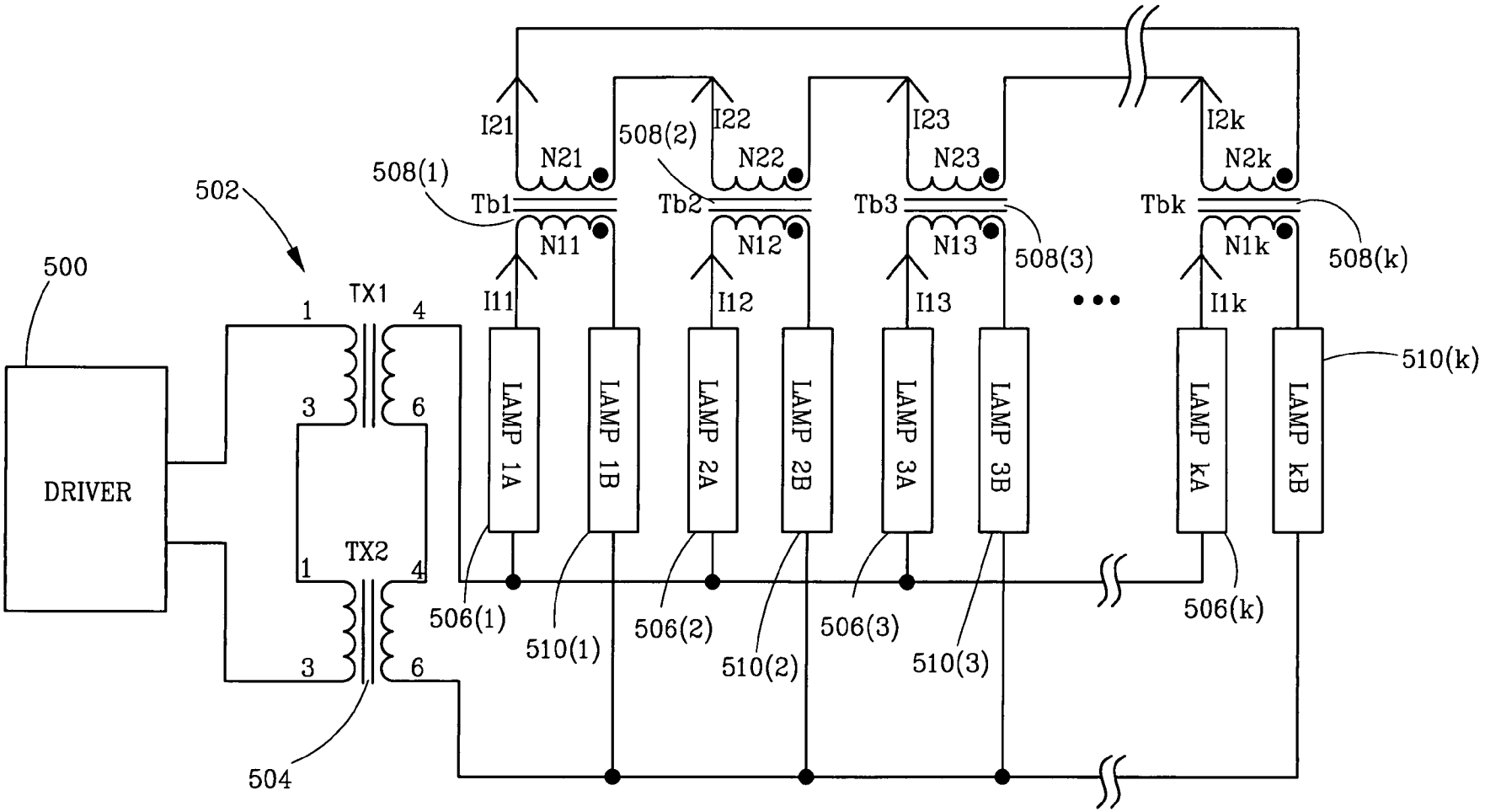
FIG. 5 is a schematic diagram of another embodiment of a backlight system with multiple lamps driven in a floating configuration.

FIG. 5 is a schematic diagram of another embodiment of a backlight system with multiple lamps driven in a floating configuration. FIG. 5 illustrates a selective combination of FIGS. 3 and 4. Similar to FIG. 3, a ring balancer is inserted between multiple pairs of serial lamps connected in parallel across a common source. Similar to FIG. 4, the common source includes a driver circuit 500 coupled to an output transformer stage comprising of two serially connected transformers 502, 504.

For example, a first group of lamps (LAMP 1A, LAMP 2A, . . . LAMP kA) shown as lamps 506(1)–506(*k*) (collectively the first group of lamps 506) are coupled between a first terminal the output transformer stage and the ring balancer. A second group of lamps (LAMP 1B, LAMP 2B, . . . LAMP kB) shown as lamps 510(1)–510(*k*) (collectively the second group of lamps 510) are coupled between the ring balancer and a second terminal of the output transformer stage. The ring balancer comprises a plurality of balancing transformers (Tb1, Tb2, . . . Tbk) shown as balancing transformers 508(1)–508(*k*) (collectively the balancing transformers 508). Each of the balancing transformers 508 is designated for a pair of lamps, one lamp from the first group of lamps 506 and one lamp from the second group of lamps 510.

The balancing transformers 508 have respective primary windings inserted in series between their designated pairs of lamps. The first group of lamps 506 and the second group of lamps 510 are effectively coupled in series by pairs with a different primary winding inserted between each pair. The pairs of lamps with respective designated primary windings are coupled in parallel across the serially connected secondary windings of the transformers 502, 504 in the output transformer stage. The balancing transformers 508 have respective secondary windings serially connected in a closed loop. As discussed above, the number of balancing transformers 508 is advantageously half the number of lamps 506, 510 to be balanced in this configuration.

Figure 6:
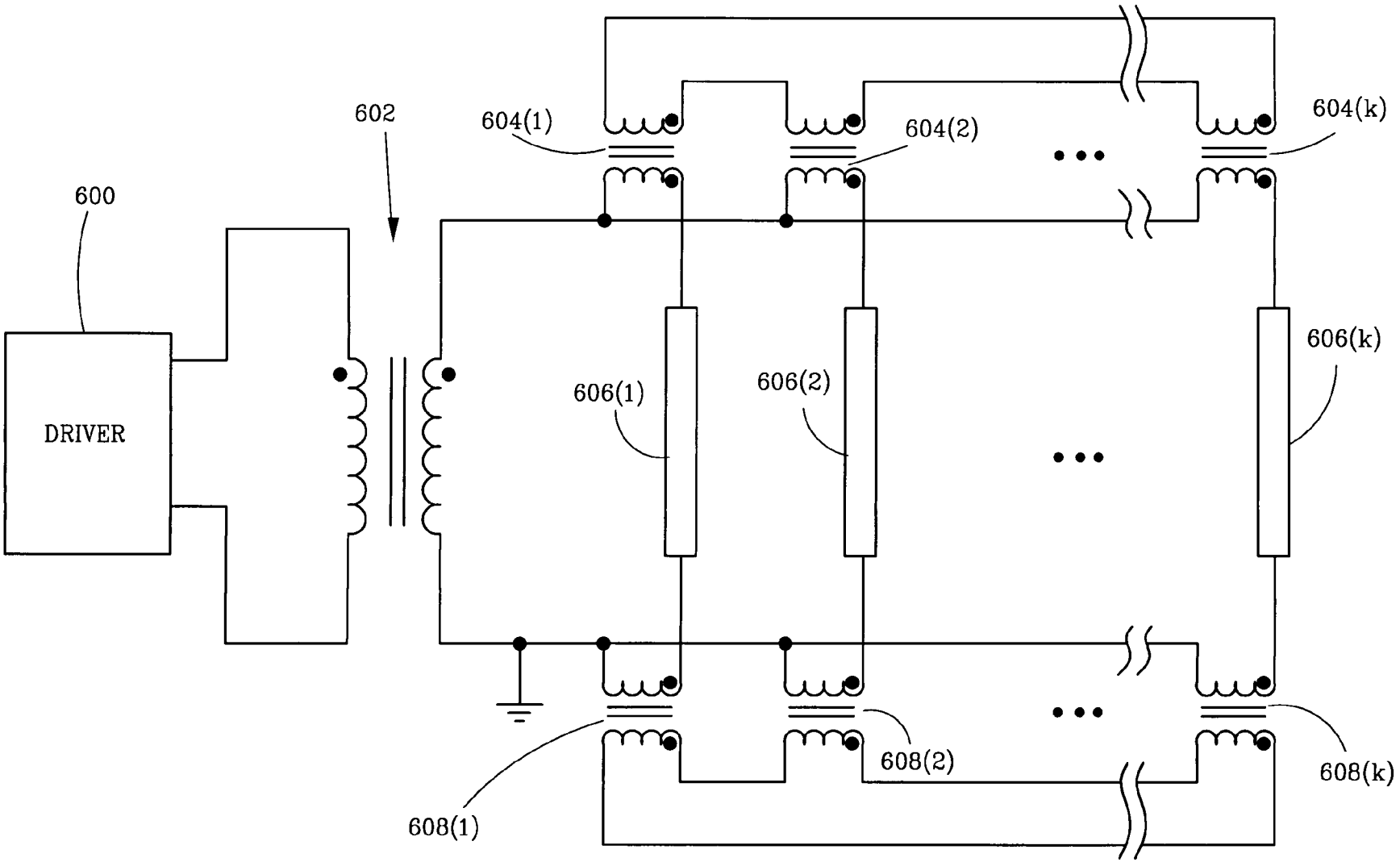
FIG. 6 is a schematic diagram of one embodiment of a backlight system with two ring balancers, one at each end of parallel lamps.

FIG. 6 is a schematic diagram of one embodiment of a backlight system with two ring balancers, one at each end of parallel lamps shown as lamps 606(1)–606(*k*) (collectively the lamps 606). The first ring balancer comprises a first plurality of balancing transformers shown as balancing transformers 604(1)–604(*k*) (collectively the first set of balancing transformers 604). Secondary windings in the first set of balancing transformers 604 are serially coupled together in a first closed ring. The second ring balancer comprises a second plurality of balancing transformers shown as balancing transformers 608(1)–608(*k*) (collectively the second set of balancing transformers 608). Secondary windings in the second set of balancing transformers 608 are serially coupled together in a second closed ring.

Each of the lamps 606 is associated with two different balancing transformers, one from the first set of balancing transformers 604 and one from the second set of balancing transformers 608. Thus, primary windings in the first set of balancing transformers 604 are coupled in series with their associated lamps 606 and corresponding primary windings in the second set of balancing transformers 608. The serial combinations of lamp with different primary windings on both ends are coupled in parallel across a common source. In FIG. 6, the common source (e.g., an inverter) is shown as a driver 600 coupled to an output transformer 602. The output transformer 602 may drive the lamps 606 and ring balancers in a floating configuration or have a secondary winding with one terminal connected to ground as shown in FIG. 6.

Figure 7:
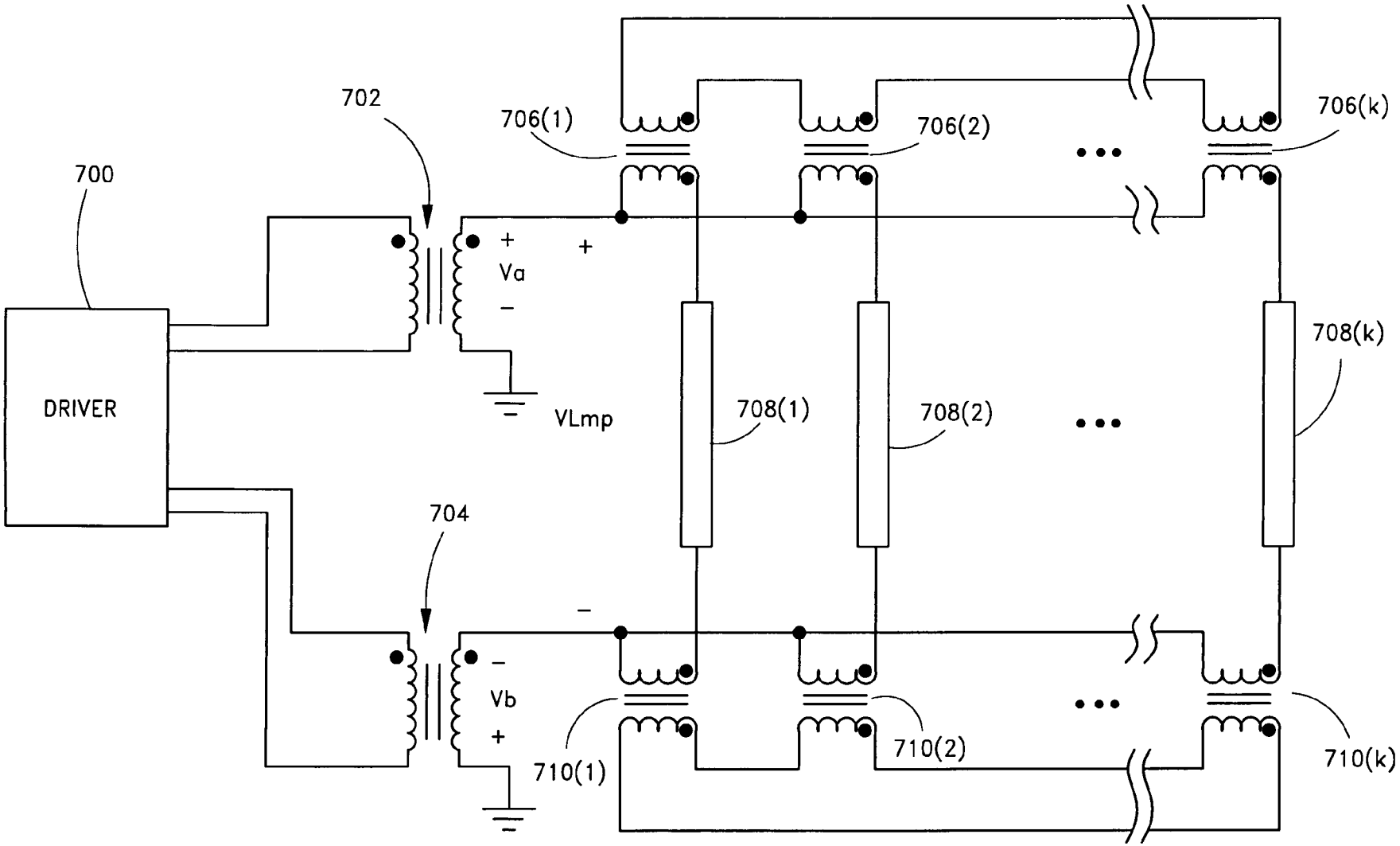
FIG. 7 is a schematic diagram of one embodiment of a backlight system with multiple lamps driven in a differential configuration.

FIG. 7 is a schematic diagram of one embodiment of a backlight system with multiple lamps driven in a differential configuration. As an example, the embodiment includes two ring balancers coupled on respective ends of a plurality of lamps shown as lamps 708(1)–708(*k*) (collectively the lamps 708). The connections between the ring balancers and the lamps 708 are substantially similar to corresponding connections shown in FIG. 6.

The first ring balancer includes a plurality of balancing transformers shown as balancing transformers 706(1)–706(*k*) (collectively the first group of balancing transformers 706). The first group of balancing transformers 706 have respective secondary windings coupled in a closed loop to balance currents among the lamps 708. The second ring balancer includes a plurality of balancing transformers shown as balancing transformers 710(1)–710(*k*) (collectively the second group of balancing transformers 710). The second group of balancing transformers 710 have respective secondary windings coupled in another closed loop to reinforce or provide redundancy in balancing currents among the lamps 708.

Each of the lamps 708 is associated with two different balancing transformers, one from the first group of balancing transformers 706 and one from the second group of balancing transformers 710. Primary windings in the first group of balancing transformers 706 are coupled in series with their associated lamps 708 and corresponding primary windings in the second group of balancing transformers 710. The serial combinations of lamp with different primary windings on both ends are coupled in parallel across a common source.

In FIG. 7, the common source (e.g., a split phase inverter) is shown as a driver 700 coupled to a pair of output transformers 702, 704 which are driven by phase-shifted signals or signals with other switching patterns to produce differential signals (Va, Vb) across secondary windings of the respective output transformers 702, 704. The differential signals combine to generate an AC lamp voltage (Vlmp=Va+Vb) across lamps 708 and ring balancers. Further details on the split phase inverter are discussed in Applicant's copending U.S. patent application Ser. No. 10/903,636, filed on Jul. 30, 2004, and entitled "Split Phase Inverters for CCFL Backlight System," the entirety of which is incorporated herein by reference.

Figure 8:
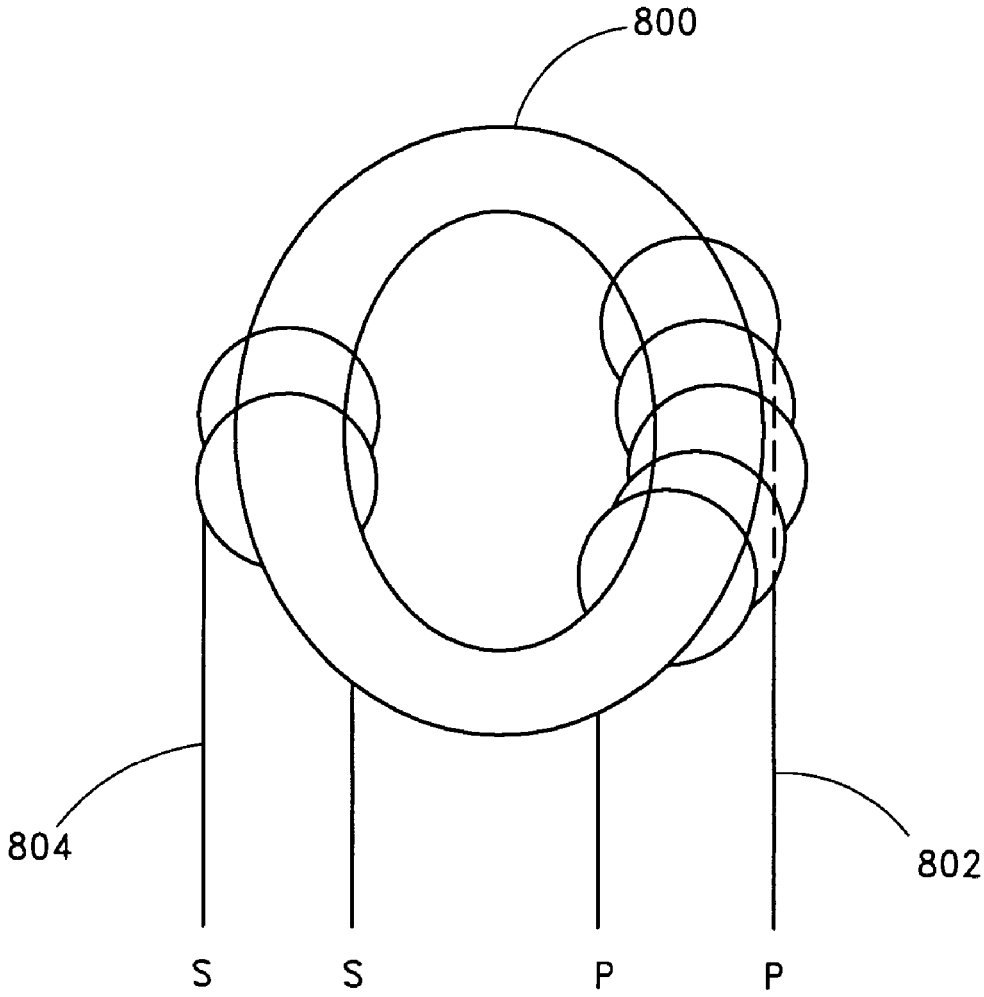
FIG. 8 illustrates one embodiment of a toroidal core balancing transformer in accordance with the present invention.

FIG. 8 illustrates one embodiment of a toroidal core balancing transformer in accordance with the present invention. A primary winding 802 and a secondary winding 804 are directly wound on the toroidal core 800. In one embodiment, the primary winding 802 on the toroidal core 800 is wound progressively, instead of in overlapped multiple layers, to avoid high potential between primary turns. The secondary winding 804 can be likewise wound progressively.

The wire gauge for the windings 802, 804 should be selected based on the current rating, which can be derived from Eqn. 1 and Eqn. 2. The balancing transformers in a ring balancer advantageously work with any number of secondary turns or primary-to-secondary turns ratios. A good balancing result can be obtained with different turns ratios according to the relationship established in Eqn. 1 and Eqn. 2. In one embodiment, a relatively small number of turns (e.g., 1–10 turns) is chosen for the secondary winding 804 to simplify the winding process and to lower the manufacturing cost. Another factor to determine the desired number of secondary turns is the desired voltage signal level across the secondary winding 804 for a fault detection circuit, which is discussed in further detail below.

Figure 9:
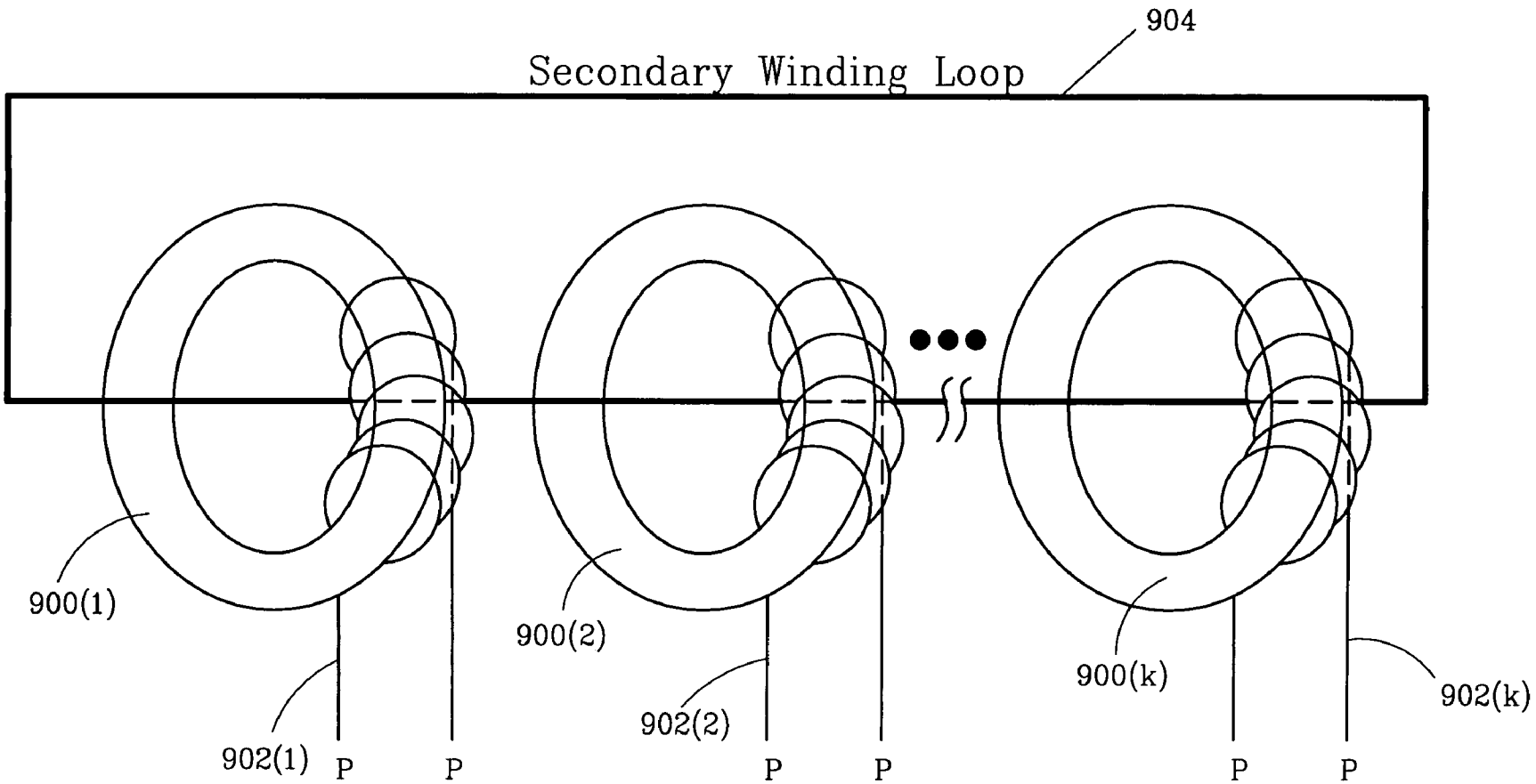
FIG. 9 is one embodiment of a ring balancer with a single turn secondary winding loop.

FIG. 9 is one embodiment of a ring balancer with a single turn secondary winding loop 904. The ring balancer comprises a plurality of balancing transformers using toroidal cores shown as toroidal cores 900(1)–900(*k*) (collective the toroidal cores 900). Primary windings shown as primary windings 902(1)–902(*k*) (collectively the primary windings 902) are progressively wound on the respective toroidal cores 900. A single insulated wire goes through the inner holes of the toridal cores to 900 form a single turn secondary winding loop 904.

Figure 10:
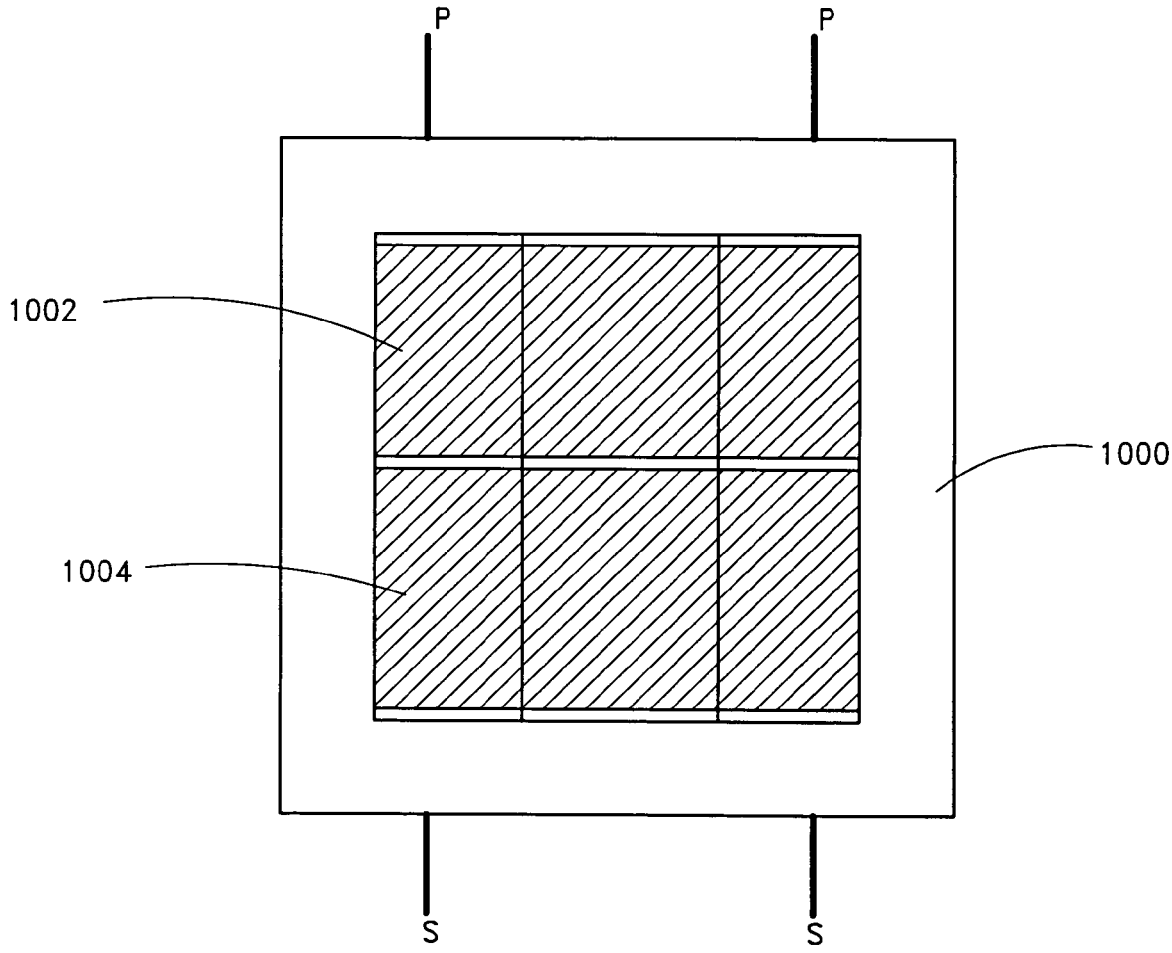
FIG. 10 is one embodiment of a balancing transformer using an E-core based structure.

FIG. 10 is one embodiment of a balancing transformer using an E-core based structure 1000. A winding bobbin is used. The bobbin is divided into two sections with a first section 1002 for the primary winding and a second section 1004 for the secondary winding. One advantage of such a winding arrangement is better insulation between the primary and secondary windings because a high voltage (e.g., a few hundred volts) can be induced in the primary windings during striking or open lamp conditions. Another advantage is reduced cost due to a simpler manufacturing process.

An alternative embodiment of the balancing transformer (not shown) overlaps the primary winding with the secondary winding to provide tight coupling between the primary and secondary windings. Insulation between the primary and secondary windings, manufacturing process, etc. becomes more complex with overlapping primary and secondary windings.

The balancing transformers used in a ring balancer can be constructed with different types of magnetic cores and winding configurations. In one embodiment, the balancing transformers are realized with relatively high permeability materials (e.g., materials with initial relative permeability greater than 5,000). The relatively high permeability materials provide a relatively high inductance with a given window space at the rated operating current. In order to obtain good current balancing, the magnetizing inductance of the primary winding should be as high as possible, so that during operation the magnetizing current can be small enough to be negligible.

The core loss is normally higher for relatively high permeability materials than for relatively low permeability materials at a given operating frequency and flux density. However, the working flux density of the transformer core is relatively low during normal operations of the balancing transformer because the magnitude of the induced voltage in the primary winding, which compensates for the variations in operating lamp voltage, is relatively low. Thus, the use of relatively high permeability materials in the balancing transformer advantageously provides relatively high inductance while maintaining the operational loss of the transformer at a reasonably low level.

Figure 11:
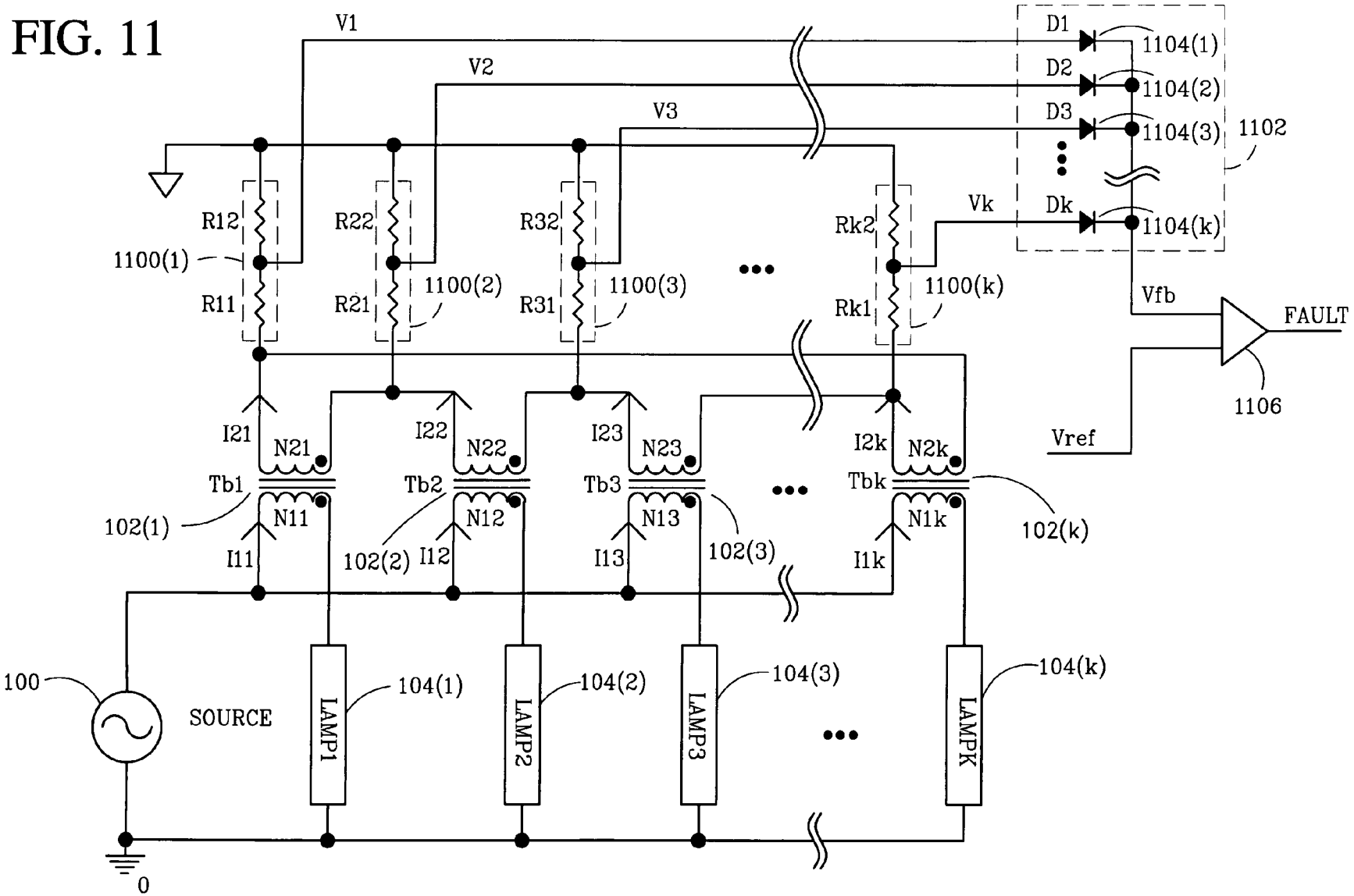
FIG. 11 illustrates one embodiment of a fault detection circuit coupled to a ring balancer to detect presence of non-operational lamps.

FIG. 11 illustrates one embodiment of a fault detection circuit coupled to a ring balancer to detect presence of non-operational lamps. The configuration of the backlight system shown in FIG. 11 is substantially similar to the one shown in FIG. 1 with multiple lamps 104, a common source 100 and the ring balancer comprising a plurality of balancing transformers 102. The backlight system in FIG. 11 further includes the fault detection circuit to monitor voltages at the secondary windings of the balancing transformers 102 to detect a non-operating lamp condition.

Lamp currents conducted by the multiple lamps 104 are balanced by connecting designated primary windings of the balancing transformers 102 in series with each lamp while secondary windings of the balancing transformers 102 are connected together in a serial loop with a predefined polarity. During normal operations, a common current circulating in each of the secondary windings forces currents in the primary windings to equalize with each other, thereby keeping the lamp currents balanced.

Any error current in a primary winding effectively generates a balancing voltage in that primary winding to compensate for tolerances in lamp operating voltages which can vary up to 20% from the nominal value. A corresponding voltage develops in the associated secondary winding and is proportional to the balancing voltage.

The voltage signal from the secondary windings of the balancing transformers 102 can be monitored to detect open lamp or shorted lamp conditions. For example, when a lamp is open, the voltages in both the primary and secondary windings of the corresponding balancing transformer 102 will rise significantly. When a short circuit occurs with a particular lamp, voltages in transformer windings associated with non-shorted lamps rise. A level detection circuit can be used to detect the rising voltage to determine the fault condition.

In one embodiment, open lamp or shorted lamp conditions can be distinctively detected by sensing voltages at the secondary windings of the balancing transformers 102 and comparing the sensed voltages to a predetermined threshold. In FIG. 11, voltages at the secondary windings are sensed with respective resistor dividers shown as resistor dividers 1100(1)–1100(*k*) (collectively the resistors dividers 1100). The resistor dividers 1100, each comprising of a pair of resistors connected in series, are coupled between predetermined terminals of the respective secondary windings and ground. The common nodes between the respective pair of resistors provide sensed voltages (V1, V2, . . . Vk) which are provided to a combining circuit 1102. In one embodiment, the combining circuit 1102 includes a plurality of isolation diodes shown as isolation didoes 1104(1)–1104(*k*) (collectively the isolation diodes 1104). The isolation diodes 1104 form a diode OR-ed circuit with anodes individually coupled to the respective sensed voltages and cathodes commonly connected to generate a feedback voltage (Vfb) corresponding to the highest sensed voltage.

In one embodiment, the feedback voltage is provided to a positive input terminal of a comparator 1106. A reference voltage (Vref) is provided to a negative input terminal of the comparator 1106. When the feedback voltage exceeds the reference voltage, the comparator 1106 outputs a fault signal (FAULT) to indicate the presence of one or more non-operating lamps. The fault signal can be used to turn off the common source powering the lamps 104.

The fault detection circuit described above advantageously has no direct connection to the lamps 104, thus reducing the complexity and cost associated with this feature. It should be noted that many different types of fault detection circuits can be designed to detect fault lamp conditions by monitoring the voltages at the secondary windings in a ring balancer.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A backlight system comprising:

a plurality of lamp structures in a parallel configuration;

a common alternating current source for powering the plurality of lamp structures, wherein the common alternating current source is an inverter comprising a controller, a switching network and an output transformer stage; and a ring balancer coupled in series with the plurality of lamp structures across the common alternating current source, wherein the ring balancer comprises a plurality of balancing transformers with respective primary windings and respective secondary windings, each of the primary windings connected in series with a corresponding lamp structure, and at least two of the secondary windings serially connected in a closed loop.

2. The backlight system of claim 1, wherein the balancing transformers have substantially identical turns ratios to force the plurality of lamp structures to conduct substantially equal currents.

3. A backlight system comprising:

a plurality of lamp structures in a parallel configuration;

a common alternating current source for powering the plurality of lamp structures;

a ring balancer coupled in series with the plurality of lamp structures across the common alternating current source, wherein the ma balancer comprises a plurality of balancing transformers with respective primary windings and respective secondary windings, each of the primary windings connected in series with a corresponding lamp structure, and at least two of the secondary windings serially connected in a closed loop; and a fault detection circuit to detect non-operating lamp conditions by sensing a voltage rise in one or more of the secondary windings of the balancing transformers.

4. The backlight system of claim 3, wherein the common alternating current source is a single voltage source or a plurality of synchronized voltage sources.

5. The backlight system of claim 3, wherein the primary windings of the balancing transformers are connected between the high voltage terminals of the respective lamp structures and the common alternating current source.

6. The backlight system of claim 3, wherein the primary windings of the balancing transformers are connected between the return terminals of the respective lamp structures and ground.

7. The backlight system of claim 3, wherein the balancing transformers have substantially identical turns ratios to force the plurality of lamp structures to conduct substantially equal currents.

8. A display panel comprising:

an inverter configured to drive a plurality of parallel fluorescent lamps with a single-ended output;

a first ring balancer inserted between the single-ended output and high voltage terminals of the respective fluorescent lamps, wherein the first ring balancer has a first plurality of balancing transformers with respective primary windings individually coupled in series with the corresponding fluorescent lamps and secondary windings connected in a closed loop; and a second ring balancer inserted between return terminals of the respective fluorescent lamps and ground, wherein the second ring balancer has a second plurality of balancing transformers with respective primary windings individually coupled in series with the corresponding fluorescent lamps and secondary windings connected in a closed loop.

9. A display panel comprising:

an inverter configured to drive a plurality of parallel fluorescent lamps with differential outputs;

a first ring balancer inserted between a first differential output of the inverter and first terminals of the respective fluorescent lamps, wherein the first ring balancer has a first plurality of balancing transformers with respective primary windings separately coupled in series with the respective fluorescent lamps and secondary windings connected in a closed loop; and a second ring balancer inserted between second terminals of the respective fluorescent lamps and a second differential output of the inverter, wherein the second ring balancer has a second plurality of balancing transformers with respective primary windings separately coupled in series with the respective fluorescent lamps and secondary windings connected in a closed loop.

10. A method to balance currents among multiple lamps in a backlight system, the method comprising the acts of:

designating a balancing transformer for each parallel branch of one or more lamps, wherein a primary winding of the balancing transformer is coupled in series with the lamps of the designated branch;

connecting secondary windings of the balancing transformers in a serial ring configuration to conduct a common current; and detecting faulty lamps by sensing an increase in voltage across one or more secondary windings.

11. The method of claim 10, wherein the balancing transformers have substantially identical turns ratios to force the parallel branches to conduct substantially identical currents.

12. The method of claim 10, further comprising the act of using a common AC source to power the parallel branches of lamps.

* * * * *

UNITED STATES PATENT AND TRADEMARK OFFICE

CERTIFICATE OF CORRECTION

PATENT NO. : 7,242,147 B2
APPLICATION NO. : 10/958668
DATED : July 10, 2007
INVENTOR(S) : Xiaoping Jin It is certified that error appears in the above-identified patent and that said Letters Patent is hereby corrected as shown below:

Claim 1, column 11, line 59 after "stage" add --, wherein the inventor has a transformer with a secondary winding referenced to ground to drive the plurality of lamp structures in a single-ended configuration--

Signed and Sealed this

Eighteenth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 7,242,147 B2
APPLICATION NO. : 10/958668
DATED : July 10, 2007
INVENTOR(S) : Xiaoping Jin It is certified that error appears in the above-identified patent and that said Letters Patent is hereby corrected as shown below:

At column 9, line 60, please delete “toridal” and insert -- toroidal --, therefor.

At column 11, line 18, please delete “didoes” and insert -- diodes --, therefor.

At column 11, line 59, in Claim 1, please delete “stage;” and insert -- stage, wherein the inverter has a transformer with a secondary winding referenced to ground to drive the plurality of lamp structures in a single-ended configuration; --, therefor.

At column 12, line 11, in Claim 3, please delete “ma” and insert -- ring --, therefor.

Signed and Sealed this

Twenty-seventh Day of November, 2007

JON W. DUDAS
*Director of the United States Patent and Trademark Office*